United States Patent [19]

Herzog

[11] 4,116,334

[45] Sep. 26, 1978

[54] PACKAGED ARTICLES

[75] Inventor: Milton W. Herzog, Valley Stream, N.Y.

[73] Assignee: H. Goodman & Sons, Inc., Kearny, N.J.

[21] Appl. No.: 694,896

[22] Filed: Jun. 10, 1976

[51] Int. Cl.[2] ..... B65D 85/48

[52] U.S. Cl. ..... 206/453; 206/454; 206/586

[58] Field of Search ..... 206/313, 453, 454, 455, 206/573, 581, 583, 585, 586, 595; 229/14 C

[56] References Cited

U.S. PATENT DOCUMENTS

| | | | |
|---|---|---|---|
| 2,626,050 | 1/1953 | Freiberg | 206/453 |
| 2,681,733 | 6/1954 | Welshenbach | 206/453 |
| 2,684,153 | 7/1954 | Freiberg | 206/453 |
| 2,728,451 | 12/1955 | Leander | 206/453 |
| 2,742,219 | 4/1956 | Antwerpen | 206/454 |
| 2,750,032 | 6/1956 | Laird | 206/453 |
| 2,812,855 | 11/1957 | Antwerpen | 206/453 |
| 3,516,538 | 6/1970 | Antwerpen | 206/453 |

FOREIGN PATENT DOCUMENTS

| | | | |
|---|---|---|---|
| 20,805 of | 1907 | United Kingdom | 206/453 |

*Primary Examiner*—William Price
*Assistant Examiner*—Bruce H. Bernstein

[57] ABSTRACT

The disclosed packages include a merchandise unit needing protection against impact during shipment, especially a stack of articles such as mirrors, firmly contained in a liner that surrounds the merchandise unit. Inward off-sets of the liner block up-and-down sliding and, in the case of plural articles such as mirrors, the off-sets hold the articles together. The edges of the liner and especially the edges of the off-sets support the contents between the walls of a carton.

7 Claims, 7 Drawing Figures

FIG. 1
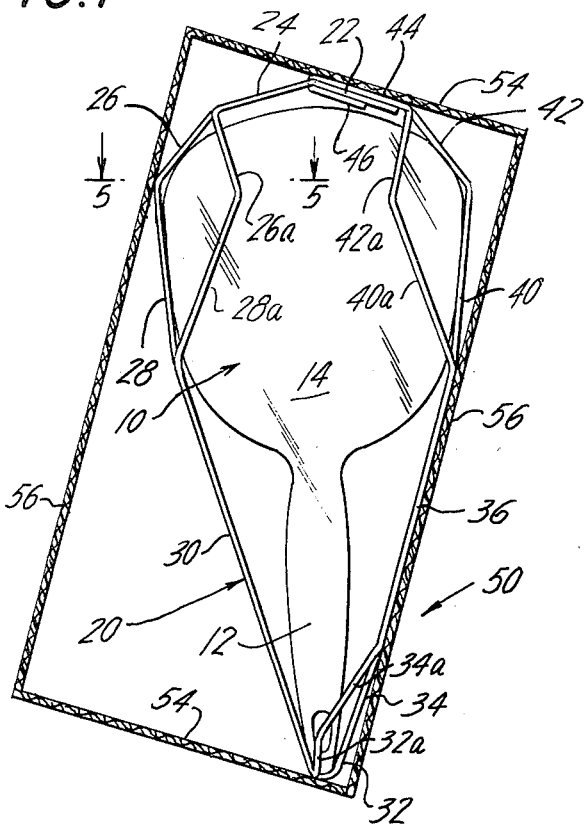
FIG. 2
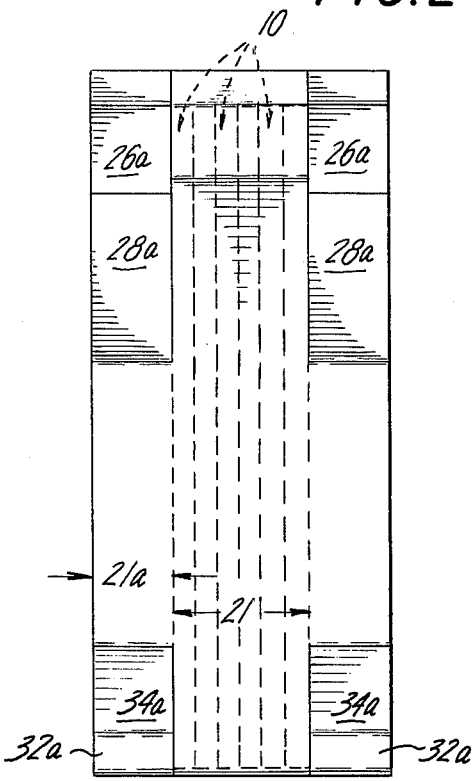
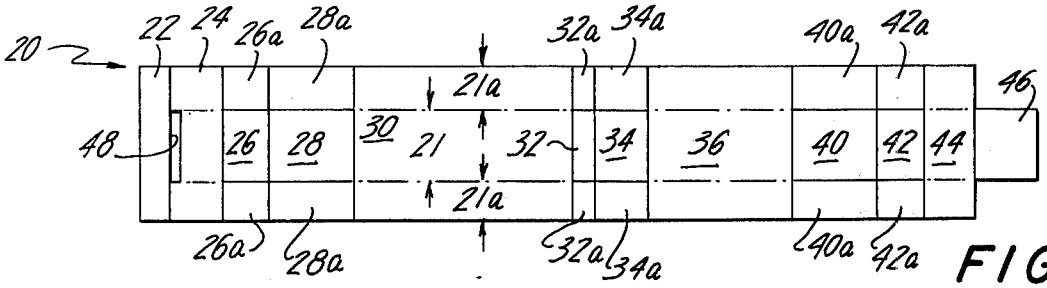
FIG. 3
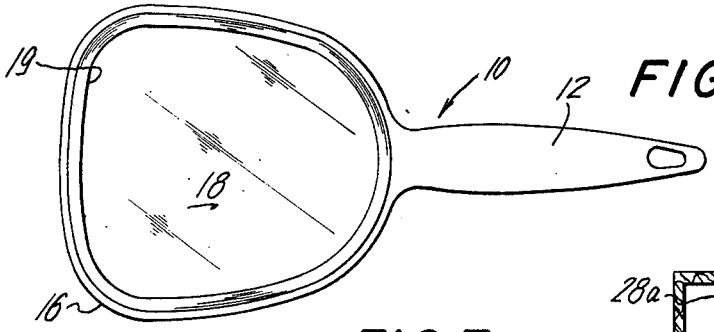
FIG. 4
FIG. 5
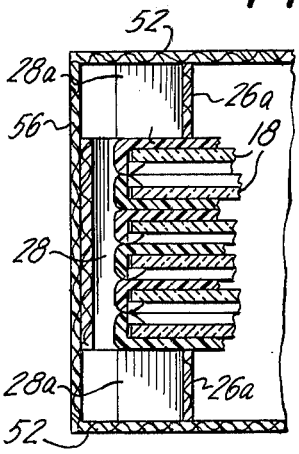
FIG. 6
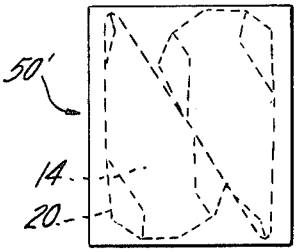
FIG. 7
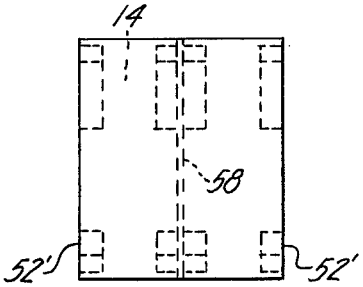

PACKAGED ARTICLES

FIELD OF THE INVENTION

This invention relates to packaged articles, especially articles secured by liners snugly in position in outer packaging material.

BACKGROUND OF THE INVENTION

It has long been a common practice to provide liners of various forms and various materials to hold articles in position in shipping cartons. Many separate pieces of corrugated cardboard of various shapes have been used to hold an article in position in a carton. Foamed plastic molded to conform to the shape of the article has also been used. Moreover, where many fragile articles are to be packed in a carton, it is common practice to isolate each article from the others by cushioning material, or to locate each article individually in the carton. Such arrangements tend to be expensive, a concern of special importance where the articles are relatively inexpensive and where packing cost could add considerably to the delivered cost of the articles without adding anything to the value of the articles.

SUMMARY OF THE INVENTION

An object of the invention resides in the provision of new, highly effective and economical forms of liners cooperating with articles and with a carton or other container to secure the articles firmly in position in the container, thereby to minimize shipping hazards.

A novel liner here surrounds a merchandise unit, and has inward off-sets arranged to inhibit up-and-down sliding of the merchandise unit in the surrounding liner. As a further feature, the merchandise unit is a stack of articles, and they are held together without need for cushioning separators by the same inward off-sets that bear against the container walls for avoiding looseness and shifting of the merchandise in the container.

As a specific feature, the liner has an outward bowed region where it surrounds an article; and at that region, the liner has an inward buckled pair of integrally connected panels serving as one of the inward off-sets that block up-and-down sliding of merchandise in the surrounding liner.

As a still more specific and subsidiary feature, the elongated liner blank has a tab at one end and a slot near the opposite end; and when the liner is shaped to receive the merchandise unit (but before the merchandise is inserted) the tab is inserted through the slot from the outside and the tab is bent back at the inside of the thus erected liner. Then, when an article is inserted within the surrounding liner and against or close to the tab, the latter cannot become released so that glue and glued tape are not needed to hold the liner erected when this feature is used.

The nature of the invention, its various objects, features and advantages including those expressed above, will be best appreciated from the following detailed description of a presently preferred embodiment which is shown in the accompanying drawing.

DESCRIPTION OF THE DRAWINGS

FIG. 1 is a top plan view of an embodiment of the invention in its various aspects, representing a stack of hand mirrors and a liner and including an enclosing carton with the top wall cut away, for clarity;

FIG. 2 is a lateral view of the embodiment of FIG. 1, omitting the enclosing carton;

FIG. 3 is a view of the liner of FIGS. 1 and 2 drawn to reduced scale, the liner being opened flat and viewed from the side that becomes the inner surface of the liner when in use;

FIG. 4 is a front view of one of the hand mirrors of FIGS. 1 and 2;

FIG. 5 is a fragmentary cross-section of the embodiment of FIGS. 1 and 2 as seen at the plane 5—5 in FIG. 1;

FIG. 6 is a plan view of a modification of FIG. 1, drawn to reduced scale; and FIG. 7 is a lateral elevation of the modification of FIG. 6.

DESCRIPTION OF THE ILLUSTRATIVE EMBODIMENTS

The presently preferred embodiment of the invention is especially applicable to packing groups of mirrors that are alike in size and shape. A hand mirror 10 is shown in FIG. 4, including a handle 12 and back 14 (FIGS. 1 and 5) and an outer rim 16 formed of plastic in this example. A rear-silvered glass reflector 18 is held in place by a bezel 19 of plastic united to the back of the mirror.

Liner 20 is shown in its flat, developed condition as a blank in FIG. 3. Its lateral edges are parallel. It is made of stiff sheet material, especially corrugated cardboard, and it is divided into a medial portion and two further marginal portions. The width 21 of the medial portion equals or is slightly less than the height of the stack of mirrors (FIGS. 4 and 5). The two further marginal portions are of equal width **21*a* and they extend virtually all along the liner. The lines across the liner blank in FIG. 3 represent scores or creases formed in one face of the liner, dividing the liner into panels 22, 24, 26 and 26*a*, 28 and 28*a*, 30, 32 and 32*a*, 34 and 34*a*, 36, 40 and 40*a*, 42 and 42*a*, and 44. A tab 46 extends from panel 44, to enter slot 48 when the liner is erected. Parallel cuts through the cardboard divide panels 26*a* and 28*a* from panels 26 and 28; divide panels 32*a* and 34*a* from panels 32 and 34; and divide panels 40*a* and 42*a* from panels 40 and 42**.

A stable stack of six mirrors 10 (in this example) forms a merchandise unit to be packed. Each mirror bears against the next in the stack over a relatively large area. They can be separated by sheets of paper to avoid their damaging one another by rubbing during shipment and handling, but this has not been found necessary. The liner blank in this example is erected roughly into tear-drop shape with the creases on the inside. Tab 46 is inserted through slot 48 and bent back as shown in FIG. 1. At this time the upper set of panels **26*a* and 28*a* along one edge of the liner are buckled outward in alignment with panels 26 and 28, and upper pairs of panels 32*a*—34*a* and 40*a*—42*a* are also buckled outward. The corresponding lower pairs of panels 26*a* and 28*a* (etc.) along the opposite edge of the liner are buckled inward, here at an obtuse angle. The mirrors are then loaded into the liner. This has the effect of arresting tab 46 in the position shown. Tab 46 cannot escape, so that the liner is secured in position about the mirrors without resort to glue or glued tape. After the mirrors are in place, the second set of panels 26*a*, 28*a*; 32*a*, 34*a*; and 40*a*, 42*a* are forcibly buckled inward as shown in FIG. 1**. Each inward-buckled pair of panels is stable and must remain buckled because the ends of that pair of panels are closer together than the combined lengths of the panels. The corresponding panels of the medial portion of the liner are buckled outward.

To complete the package, the mirrors united as a sub-package by liner 20 are placed in a carton 50, commonly made of corrugated cardboard.

Referring to FIGS. 2 and 5, the cut inner edges of the inward-buckled pairs of panels 26*a* and 28*a*, 32*a* and 34*a*, and 40*a* and 42*a* firmly confine the mirrors in the stack against each other. The width of the inward-buckled pairs of panels and the dimensions of the carton 50 that establish the space between walls 52 are related properly so that opposite walls 52 of carton 50 bear firmly against the edges of the inward buckled panels. This avoids looseness of the contents in the carton, which resists damage during shipping. Individual inward-extending panels similar to panels 26*a*, 34*a* and 40*a* (apart from their companion panels 28*a*, 32*a* and 42*a*) would be effective for confinging the stack of mirrors together and for bearing against opposite walls of the carton. However, the buckled pairs of panels serve as stable structures that hold the inward off-set panels securely in the desired positions.

The thickness of the carton material can be varied suitably; and in like sense separate flat or bent panels can be inserted (as may be expedient) between the liner and any of the side walls, the end walls and the top and bottom walls of the carton, and in that case the walls of the carton may not bear literally "against" the liner as they do in this example. Howeover, it may not be necessary for the liner to fit tightly between the end walls 54 or between side walls 56 of the carton, since the mirrors are well adapted to withstand edgewise impact that might result in handling due to such looseness. Nonetheless, it is best for the carton to confine the mirror-and-liner sub-package snugly against all movement, with or without supplementary liners.

FIGS. 6 and 7 illustrate a modification. One carton 50' contains four stacks of mirrors 14, each stack tightly held in a liner 20. Two levels of liner 14 containing stacks of mirrors are confined between top and bottom walls 52', with a dividing wall or divider 58 as of corrugated cardboard between them. The arrangement of plural subpackages in FIGS. 6 and 7 is purely illustrative, since obviously many other arrangements are contemplated. In this example, just as certain edges of the respective liners bear against walls 52' of the carton, so other edges of the liners bear against divider 58 which thus serves as an inner wall of the carton.

The illustrative embodiment of the invention in its various aspects, described above and shown in the drawings, is evidently susceptible of a wide range of modification and varied application. Consequently, the invention should be construed broadly, in accordance with its full spirit and scope.

What is claimed is:

1. A package including a merchandise unit having a peripheral surface and opposite top and bottom surfaces, and packing means including an elongated liner of stiff sheet material having parallel longitudinal edges, the width of the liner between its longitudinal edges being substantially greater than the width of said peripheral surface of the merchandise unit, said liner having a medial portion between but spaced from both of said longitudinal edges of the liner, said medial portion surrounding said merchandise unit and being divided by transverse creases into a series of panels that form successive angles buckled outward without inward-buckled angles intervening between the successive outward-buckled angles and that snugly confine the merchandise unit, said liner including further portions alongside said medial portion and bounded by said longitudinal edges, parts of said further portions of the liner forming integral lateral extensions of certain ones of said panels and other parts of said further portions of the liner forming inward buckled offsets above and below the merchandise unit, said other parts of said further portions having second longitudinal edges firmly supporting said merchandise unit against up-and-down movement in the liner.

2. A package in accordance with claim 1, wherein said merchandise unit comprises a stack of fragile articles, all of the same size and shape.

3. A package in accordance with claim 2, wherein said fragile articles are mirrors having glass reflectors and a holder for the reflectors.

4. A package in accordance with claim 1, wherein said liner includes a transverse slot and a tab remote from the slot in the extended condition of the liner, the tab extending through the slot and being bent-back within the liner and being disposed at least close to the merchandise unit which is thereby effective to prevent release of the tab, and to prevent opening of the liner.

5. A package in accordance with claim 1, further including a container having side and end walls and parallel opposite walls across said side and end walls cooperating with said parallel longitudinal edges of the liner for containing and securely supporting the liner and the merchandise unit in the liner.

6. A package in accordance with claim 1, wherein at least one of said inward off-sets consists of two panels having an obtuse angle between them.

7. A package in accordance with claim 1, wherein at least one of said inward off-sets consists of two panels having an angle between them forming a concave structure as viewed from the side of the liner, and wherein said two panels extend from said parts of said further portion of said liner that form lateral extensions of said medial portion, and wherein part of the medial portion buckles outward opposite said two panels.

* * * * *